United States Patent [19]

Kopich

[11] 4,096,836

[45] Jun. 27, 1978

[54] VARIABLE TIMING DEVICE PARTICULARLY FOR ENGINE CAMSHAFTS

[75] Inventor: Leonard F. Kopich, Madison Heights, Mich.

[73] Assignee: General Motors Corporation, Detroit, Mich.

[21] Appl. No.: 760,741

[22] Filed: Jan. 19, 1977

[51] Int. Cl.[2] ..... F01L 1/34

[52] U.S. Cl. ..... 123/90.15; 74/395

[58] Field of Search ..... 123/90.15; 74/571 R, 74/243 DR, 571 L, 571 M, 117, 395

[56] References Cited

U.S. PATENT DOCUMENTS

| | | | |
|---|---|---|---|
| 781,219 | 1/1905 | Mills | 74/395 |
| 1,138,799 | 5/1915 | Scott | 74/395 |
| 2,677,971 | 5/1954 | Greenwood | 74/395 |
| 3,789,687 | 2/1974 | Cutter | 74/243 DR |

*Primary Examiner*—Charles J. Myhre
*Assistant Examiner*—Jeffrey L. Yates
*Attorney, Agent, or Firm*—Robert J. Outland

[57] ABSTRACT

An engine camshaft drive includes timing belt pulleys which are angularly adjustable on their respective camshafts to provide manual adjustment of the engine valve timing. The arrangement features combination securing and adjusting means in the form of a threaded stud having an eccentric body portion intermediate its ends that coacts with a radially elongated opening in its associated drive sprocket to provide angular adjustment of the sprocket on the camshaft, while the stud also provides means for securing the drive sprocket to the camshaft when the adjustment has been completed.

3 Claims, 4 Drawing Figures

VARIABLE TIMING DEVICE PARTICULARLY FOR ENGINE CAMSHAFTS

This invention relates to variable timing drives and, more particularly, to camshaft drives for internal combustion engines wherein means are provided for varying the angular relation to the camshaft drive sprockets or gears with respect to their associated camshafts so as to provide for manual adjustment of the engine valve timing.

Many such arrangements have been provided in the past for use primarily in high performance automotive engines and the like, where manual adjustment of the valve timing to obtain peak performance under varying operating conditions may be desirable. Numerous mechanical devices for accomodating such camshaft timing adjustment have been provided in the past. Among these are simple arrangements in which a camshaft gear or sprocket is secured to a camshaft by one or more bolts or studs, and the openings through which the bolts or studs extend are arcuately elongated to provide limited freedom of relative angular movement between the gear or sprocket and the camshaft. Tightening of the bolts, of course, fixes the angular relation of these components in a predetermined position, subject to later adjustment.

In some prior mechanisms of the type above-described, accurate adjustment of the camshaft timing may be aided by providing a separate adjusting device in the form of a tool having an eccentric body portion disposed in aligned circular and radially elongated openings in the camshaft and sprocket, respectively, so that when the tool is rotated, the eccentric body portion engages a side of the elongated opening, causing rotation of the sprocket with respect to the camshaft to which it is loosely secured by bolts. The bolts are then tightened to retain the parts in their adjusted positions.

Such arrangements, while physically operable, have the disadvantage of requiring the provision of extra openings in the camshaft and drive sprocket or gear which involves extra machining steps and, if the physical mounting area is crowded, may reduce the strength of the camshaft-sprocket connection by weakening the web of the sprocket through an excessive removal of metal.

The present invention provides an improved arrangement for securing timing drive components such as sprockets and camshafts in which portions of the securing and adjusting devices are combined so that the number of components required and the openings which must be provided are both reduced and the strength of the associated parts is thereby increased. These and other advantages of the invention will be more fully understood from the following description of a preferred embodiment taken together with the accompanying drawing.

Figure 1:
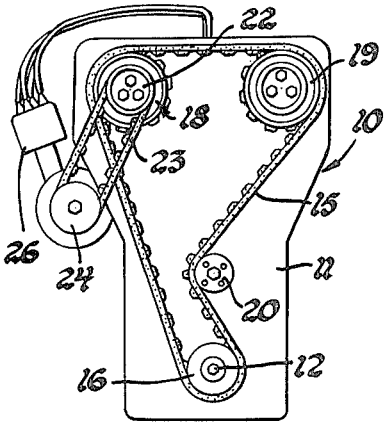
FIG. 1 is an end view of an internal combustion engine with the timing cover removed to show the arrangement of the camshaft drive train.

Referring now in detail to the drawing, there is shown in FIG. 1 an internal combustion engine generally indicated by numeral 10 and illustrative of the type having a bank of in-line cylinders, not shown, in a housing 11 which includes the usual cylinder block and head, not illustrated. The housing carries a crankshaft 12 and a pair of overhead camshafts 14 which are interconnected by a positive drive cog belt 15 that extends between a drive sprocket 16 on the crankshaft and a pair of driven sprockets 18, 19 which are mounted on the camshafts 14 so as to drive the camshafts in timed relationship with the crankshaft. The backside of the toothed or cog belt is grooved for driving engagement with a pulley 20 which is adjustable to provide for proper tensioning of the belt and also drives the associated engine water pump and the radiator fan, not shown.

A distributor drive is also provided which includes a drive sprocket 22 secured to sprocket 18 on the end of the camshaft and connected by a cog belt 23 with a driven sprocket 24 attached to a driving mechanism for the engine ignition distributor 26 which is conventionally connected with the engine spark plugs, not shown, for the various cylinders. The above-described engine camshaft drive arrangement is illustrative of a drive which has been used commercially in the four cylinder double overhead camshaft fuel injected engines of sports cars produced in the United States during the years 1975 and 1976 under the name Chevrolet Cosworth Vega.

Figure 2:
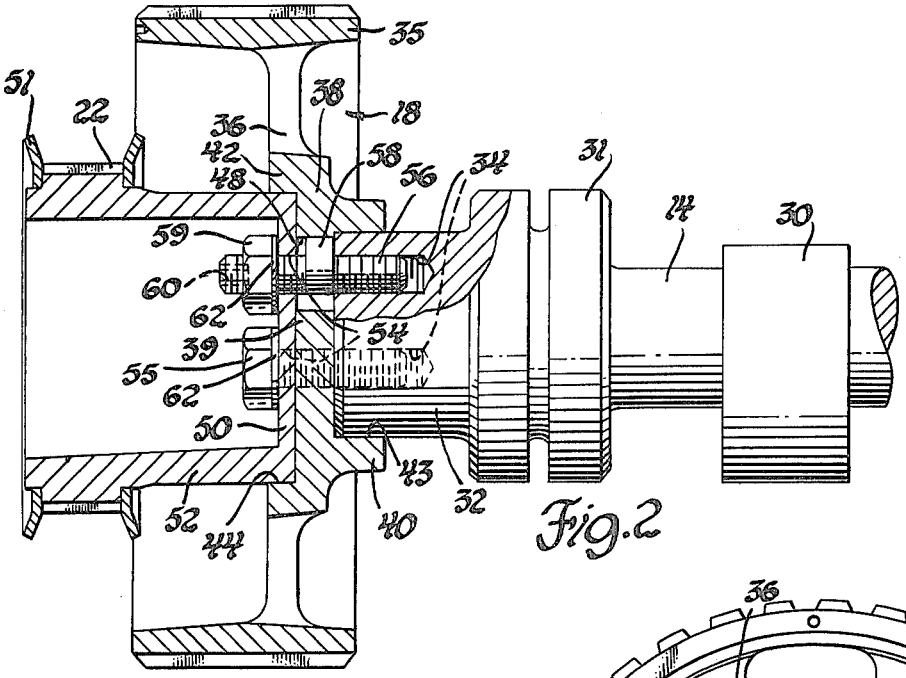
FIG. 2 is a side view of a portion of one of the engine camshafts and its drive sprocket with portions broken away to show the construction of the securing and adjusting means.
Figure 3:
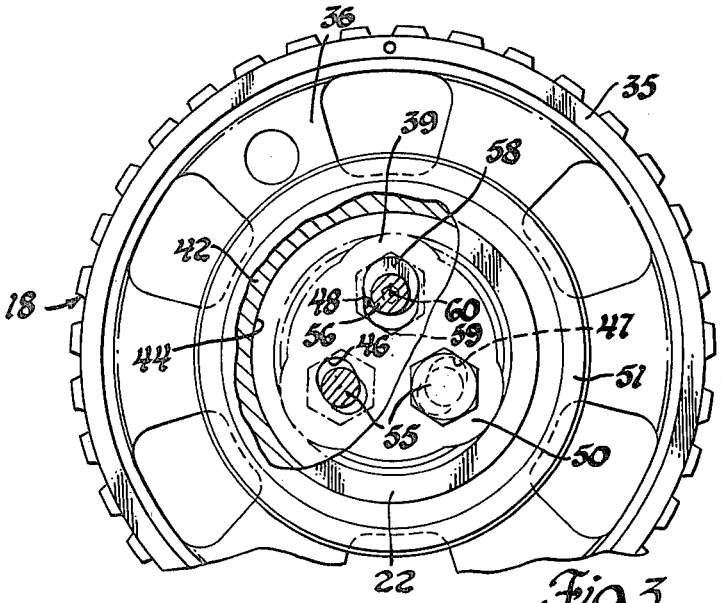
FIG. 3 is a front end view of the sprocket and camshaft assembly of FIG. 2.
Figure 4:
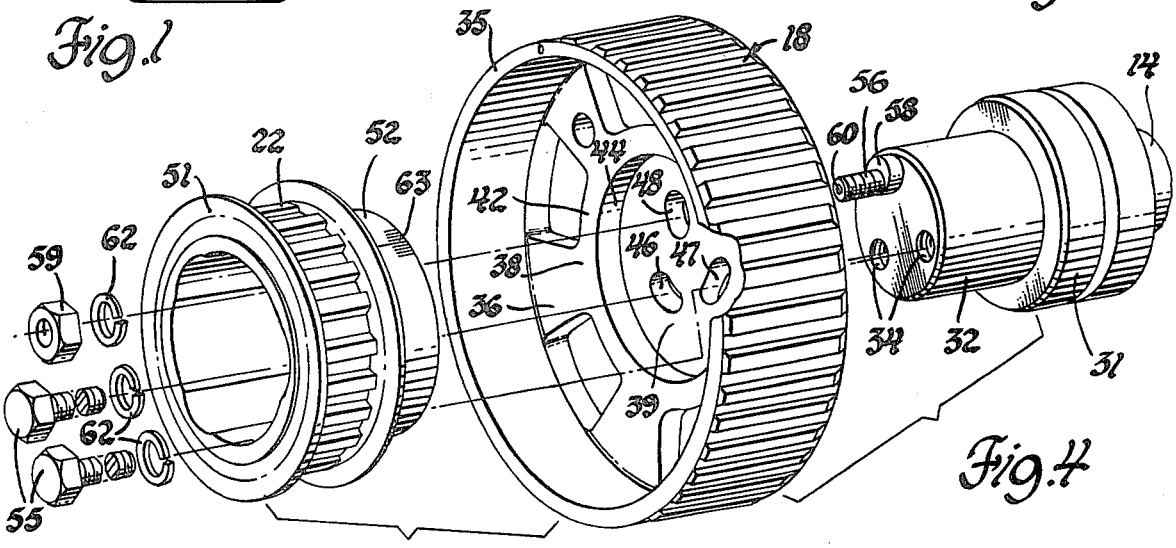
FIG. 4 is an exploded pictorial view showing the components of the assembly of FIGS. 2 and 3.

FIGS. 2-4 disclose certain portions of the engine camshaft and timing drive assembly for the right side of the engine (left side of FIG. 1). The camshaft 14 includes a plurality of cams 30 and supporting journals 31, only one of each being shown, and terminates in a cylindrical end portion 32 in the end of which are provided three equiangularly spaced threaded holes 34 extending parallel to and at equal distances from the axis of the camshaft 14.

The attached sprocket 18 includes a toothed outer rim 35 connected by a web 36 with a central hub portion 38. The hub includes a radially extending flat central portion 39 with oppositely extending annular flanges 40, 42 that define cup-shaped recesses 43, 44, respectively.

The end portion 32 of camshaft 14 fits closely within the recess 43 of the hub with the camshaft end against the hub's flat central portion 39. This portion includes three equiangularly spaced openings 46, 47 and 48 which are generally aligned with the threaded holes 34 in the camshaft. However, openings 46-48 are not round, but instead are elongated, arcuately in the case of openings 46 and 47 and radially in the case of opening 48 for purposes which will be subsequently described.

Within recess 44 of the sprocket hub 38 there is received the closed end 50 of a cup-shaped member 51 having a generally cylindrical body 52 with the toothed drive sprocket 22 being formed on the exterior of its open end. The closed end 50 of member 51 is provided with three equally spaced round openings 54 that are aligned with the threaded holes 34 of the camshaft.

The camshaft 14, driven pulley 18 and drive pulley 22 are secured together, in part, by two bolts 55 having their heads within the cup-shaped member 51 and threaded bodies extending through openings 54 of the cup end, radially elongated openings 46, 47 of the central portion 39 of sprocket 18 and into two of the threaded holes 34 in the end of the camshaft. An additional securing means is provided in the form of a special stud 56 having threaded ends and an enlarged circular eccentric cam portion 58 intermediate the threaded ends.

Stud 56 is mounted with one of its threaded ends in the threaded opening 34 of the camshaft, its central cam portion 58 disposed within the radially elongated opening 48 in the central portion 39 of sprocket 18 and its other threaded end extending through one of the openings 54 into the interior of the cup-shaped member 51. On this end, a nut 59 is threadably applied and drive means such as a hexagonal socket 60 are provided for manually rotating the stud in the camshaft by means of a tool such as an Allen wrench. Suitable lock washers 62 are preferably provided under the nut 59 and the heads of bolts 55 to prevent the bolts and the nut from loosening when they have been tightened, thus forming a secure assembly wherein the relative positions of the camshaft 14, driven sprocket 18 and drive sprocket 22 are fixed, subject to later adjustment.

It should be understood that the method of securing the second driven sprocket 19 to its respective camshaft 14 is identical to that described with respect to sprocket 18, except that the assembly of sprocket 19 does not include an auxiliary drive sprocket such as is carried by the cup-shaped member 51. Instead, in this assembly, member 51 may be deleted entirely. Preferably however, the assembly will include a plate having generally the form of the closed end 50 of member 51 to act as a non-slotted body for engagement by lock washers similar to lock washers 62. The use of such a plate is not, however, an absolute necessity of this construction.

With its components assembled as described-above, the engine camshaft drive operates conventionally, the crankshaft carried sprocket 16 moving the belt 15 to drive the sprockets 18 and 19 and their attached camshafts in timed relation to the crankshaft. Sprocket 22 in turn drives sprocket 24 and the distributor 26 at camshaft speed and in predetermined timed relation, while the belt 15, additionally, drives the pulley which connects with the engine water pump and fan.

The arrangement of the present invention permits the timing of the engine camshafts 14 to be changed relative to the timing of the engine crankshaft, thus changing the timing of the valves driven by the camshaft, without changing the timing of the distributor drive. The distributor timing itself may, of course, be adjusted within the distributor housing.

Changing the camshaft timing with the assembly shown in FIGS. 2–4 is accomplished as follows. First, the bolts 55 and nut 59 are loosened so that they do not prevent relative rotation of the sprocket 18 with respect to the camshaft. Then, a hexagonal tool such as an Allen wrench is inserted into the socket 60 and the stud 56 is rotated in its threaded opening 34. This motion causes the eccentric cam portion 58 to bear against one side of the opening 48 in the sprocket hub, causing angular rotation of the sprocket relative to the camshaft as the center of the eccentric cam 58 moves angularly relative to the position of the axis of the stud threaded portion. The sprocket 18 may be adjusted in any position within the limits of relative movement which are reached when the cam stud is rotated approximately 90° in either direction from its centered position, this movement being permitted by the angular elongation of holes 46 and 47 through which the bolts 55 extend. After the proper timing adjustment is made, the bolts 55 and the nut 59 are tightened to again secure the sprockets 18 and 22 to the camshaft, locking in the new timing adjustment of the sprocket 18.

Since the openings 54 in the sprocket carrying member 51 are sized to closely fit around the bolts 55 and stud 56, the angular adjustment of sprocket 18 does not result in a similar timing change in the sprocket 22, which remains timed with the same relative timing with respect to the camshaft no matter how the timing of sprocket 18 is adjusted. In order that a change in the timing adjustment may be accurately and positively accomplished, the cupshaped member 51 may be provided with timing marks 63 on its outer diameter, which may be compared with a single scribed timing mark, not shown, on the end of the flange 42 portion of the sprocket 18. The relative positions of the sprocket and the camshaft are thus indicated by the position of the cup-shaped member 51 on the sprocket.

Changing the timing of the other camshaft drive sprocket 19 may be accomplished in the same manner as described above for sprocket 18 and, if desired, timing marks may be applied to a plate or cup member applied in place of the member 51 in the assembly described so that a visual indication of sprocket timing will be provided.

Preferably, the cam portion 58 of the timing adjusting stud will be of cylindrical shape and the size of its associated radially elongated opening 48 in the central portion of sprocket 18 will be such as to fit closely but freely around the cam. Thus the width of opening 48 will be just slightly larger than the diameter of cam 58, while the radial length of opening 48 will equal to cam diameter plus at least the eccentricity of the cam from the axis of the stud threaded portion, with the ends of opening 48 being arcs of equivalent size to the cam diameter. With this dimensioning, stud 56 may be rotated 180 degrees in adjustment of the sprocket timing, which is sufficient to provide the maximum amount of adjustment.

While the invention has been described by reference to a specific embodiment chosen for purposes of illustration, it should be understood that the disclosed variable timing drive and eccentric stud adjusting and securing means have numerous variations and applications beyond the scope of the specific embodiment described. Thus, it is intended that the invention not be limited in its construction or application to the disclosed embodiment, but that the invention have the full scope permitted by the language of the following claims.

What is claimed is:

1. The combination in an internal combustion engine of the type having an output shaft and a camshaft operable in timed relation with the output shaft of a variable camshaft timing drive comprising a first rotatable drive member driven by the output shaft, a second rotatable drive member mounted on the camshaft and operably connected with the first drive member for rotation in timed relation therewith, means mounting said second drive member on said camshaft for rotation on a common axis, said second drive member and said camshaft having opposing engageable surfaces capable of being secured together to fix the angular relation of said members, said mounting means being formed to permit limited relative angular rotation of said members when said surfaces are not so secured, and means for adjusting the relative angular positions of said second drive member and said camshaft and for securing said second drive member to said camshaft in their adjusted positions, said adjusting and securing means comprising an adjusting and retaining stud having an elongated body with first and second threaded coaxial end portions and an eccentric cam portion intermediate said end portions, said stud having its first end portion threadably retained in said camshaft and its eccentric cam portion closely fitted between spaced parallel sides of a radially extending slotted opening in said second member, said stud second end portion including tool engageable means for rotating said stud in said camshaft to cause relative angular adjustment of the second drive member on said camshaft through engagement of the stud eccentric cam portion with said opening parallel sides, and a nut threadably received on said stud second end portion and operatively engageable with said second drive member to secure together said opposing surfaces of the camshaft and second drive member and prevent rotation of said members and said stud.

2. The combination of claim 1 and further comprising an indicating member retained on said second drive member so as to prevent relative motion therebetween, except relative angular motion, said indicating member having an opening closely fitted around the second end portion of said stud and being disposed between said nut and said second drive member whereby said indicating member is retained in fixed angular relation with said camshaft irrespective of the relative angular position of said second drive member and angular position indicating indicia on adjacent portions of said indicating member and said second drive member for indicating their relative angular positions and accordingly the relative angular positions of said second drive member and said camshaft.

3. A drive coupling assembly comprising first and second rotatable members connected for rotation on a common axis and having opposing engageable surfaces capable of being secured together to maintain said members in fixed angular relation but formed to permit limited relative angular rotation of said members when said surfaces are not so secured, and means for adjusting the relative angular positions of said members and for securing said members in their adjusted positions, said adjusting and securing means comprising an adjusting and retaining stud having an elongated body with first and second threaded coaxial end portions and an eccentric cam portion intermediate said end portions, said stud having its first end portion threadably retained in said first member, said stud extending through a slotted opening in said second member distant from said axis with the stud eccentric cam portion positioned within said slotted opening and closely fitting between angularly spaced parallel sides thereof, said second end portion including tool engageable means for rotating said stud in said first member to cause relative angular adjustment of said members through engagement of said stud eccentric cam portion with the parallel sides of said slotted opening, and a nut threadably received on said stud second end portion and operatively engageable with said second member to secure together the opposing surfaces of said first and second members and prevent rotation of said members and said stud.

* * * * *